US010161188B2

(12) United States Patent
Lorger

(10) Patent No.: US 10,161,188 B2
(45) Date of Patent: Dec. 25, 2018

(54) DYNAMIC SEAL TUBE FOR A DOWN HOLE HAMMER DRILL

(71) Applicant: Drillroc Pneumatic Pty Ltd., Queensland (AU)

(72) Inventor: Tony Lorger, Queensland (AU)

(73) Assignee: DRILLROC PNEUMATIC PTY LTD., Queensland (AU)

( * ) Notice: Subject to any disclaimer, the term of this patent is extended or adjusted under 35 U.S.C. 154(b) by 166 days.

(21) Appl. No.: 14/904,506

(22) PCT Filed: Jul. 10, 2014

(86) PCT No.: PCT/AU2014/000709
§ 371 (c)(1),
(2) Date: Jan. 12, 2016

(87) PCT Pub. No.: WO2015/003215
PCT Pub. Date: Jan. 15, 2015

(65) Prior Publication Data

US 2016/0153237 A1 Jun. 2, 2016

(30) Foreign Application Priority Data

Jul. 12, 2013 (AU) ..... 2013902580

(51) Int. Cl.

| | |
|---|---|
| ***E21B 1/30*** | (2006.01) |
| ***E21B 4/14*** | (2006.01) |
| ***E21B 1/00*** | (2006.01) |
| *E21B 21/10* | (2006.01) |

(52) U.S. Cl.
CPC ..... *E21B 4/14* (2013.01); *E21B 1/00* (2013.01); *E21B 21/10* (2013.01)

(58) Field of Classification Search
CPC ..... E21B 4/06; E21B 4/14; E21B 1/00; E21B 1/02
USPC ..... 175/296, 297
See application file for complete search history.

(56) References Cited

U.S. PATENT DOCUMENTS

| | | | | |
|---|---|---|---|---|
| 3,193,024 A | | 7/1965 | Cleary | |
| 3,527,239 A | * | 9/1970 | Boom | E21B 4/14 173/137 |
| 3,826,316 A | | 7/1974 | Bassinger | |
| 4,100,976 A | * | 7/1978 | Stone | E21B 4/14 173/133 |

(Continued)

FOREIGN PATENT DOCUMENTS

WO 1999/028586 A1 6/1999

OTHER PUBLICATIONS

International Search Report and Written Opinion for International Application No. PCT/AU2014/000709 dated Oct. 10, 2014.

(Continued)

*Primary Examiner* — Kenneth L Thompson
(74) *Attorney, Agent, or Firm* — Wegman, Hessler & Vanderburg

(57) ABSTRACT

The present invention is directed to a dynamic seal tube for use in pressurized fluid-driven down hole hammer drills. The dynamic seal tube is a tube that slides within the bore of the piston and the anvil portion of the drill bit and co-operatively acts to release different volumes of pressurized fluid from the lower chamber when the piston is in different predetermined positions.

12 Claims, 5 Drawing Sheets

(56) References Cited

U.S. PATENT DOCUMENTS

| | | | | |
|---|---|---|---|---|
| 8,011,455 | B2 * | 9/2011 | Lyon | E21B 4/14 173/207 |
| 8,109,348 | B2 * | 2/2012 | Lorger | E21B 4/14 173/13 |
| 9,068,399 | B2 * | 6/2015 | Lorger | E21B 4/14 |

OTHER PUBLICATIONS

International Preliminary Report on Patentability for International Application No. PCT/AU2014/000709 dated Jan. 12, 2016.
Chinese Office Action dated Aug. 3, 2018 for Chinese Patent Application No. 201480039475.X.

* cited by examiner

DYNAMIC SEAL TUBE FOR A DOWN HOLE HAMMER DRILL

CROSS-REFERENCE TO RELATED APPLICATIONS

This application claims the priority filing benefit of International PCT Application PCT/AU2014/000709 filed Jul. 10, 2014 and published under PCT 21(2) in the English language, and Australian Patent Application No. 2013902580 filed Jul. 12, 2013. Each of the above listed applications is incorporated herein by reference.

FIELD OF INVENTION

The present invention relates to pressurized fluid-driven impact/percussion tools and in particular to down hole hammer drills. The specification will describe the invention with reference to down hole hammer drills but the invention is not limited to this example.

BACKGROUND OF THE INVENTION

The current down hole drill is a reciprocative impact tool that attaches to the end of a drill string. The down hole hammer drill consists of a piston moving up and down within a housing repeatedly striking a drill bit anvil. The down hole hammer drill has a reciprocating action and the repeated impact of the piston on the anvil face of a drill bit fractures the rock. The fast hammer action breaks rock into small flakes and dust and is blown clear by the exhaust from the down hole hammer drill. Drill pipes are added successively as the hole becomes deeper.

Pressurized fluid moves the piston up and down as directed by fluid passing through ports which are uncovered during the movement of the piston. Pressurized fluid enters the hammer through a bore in the back-head, opens a check valve and flows through channels to the lower chamber formed between the piston and the drill bit. As the pressure increases in the lower chamber, the piston is forced upward. The upward movement continues until the piston pulls off the stationary foot valve. This allows pressurized fluid to exhaust from the lower chamber through the hollow said foot valve and drill bit and into the borehole area being drilled. Immediately after the lower chamber is exhausted, a piston recess aligns with a port to allow fluid flow into the upper chamber. Exhaust passages in the upper chamber have been sealed by the piston and the pressure in the upper chamber increases. The increased pressure in the upper chamber causes the piston to decelerate, stop and then move in the reverse direction. As the downward movement starts, and just prior to the piston striking the drill bit, the upper chamber begins to exhaust.

Upon impact, the cycle is immediately repeated. The drill bit moves freely in the chuck splines so that impact force is transmitted to drill bit cutting elements to produce rock chips. When the hammer is lifted off the bottom, the drill bit drops to an extended position where it's top shoulder rests on a retainer ring. When the drill bit is resting on the retainer ring, the drill operator can flush water and debris from the hole and accelerate periodic borehole cleaning when required.

The reciprocation of the down hole hammer entails a foot valve that is rigid and fixed in the bore of the drill bit shank and extends from the anvil face. The piston slideably engages with the fixed foot valve on the downward impact stroke forming a sealed chamber causing the piston to decelerate until it impacts with the anvil face of the drill bit. The deceleration of the piston results in transferring a reduced impact force. This problem is seen as an unavoidable inefficiency as the increased pressure in the lower chamber is necessary in order to accelerate the piston upward to start a new cycle.

This problem has been identified and addressed by others. In U.S. 8006776B1 the issue of piston deceleration was addressed by introducing an asymmetrical timing valve that delays the onset of pressurized fluid supply to the lower chamber and extends the pressurization of the upper chamber during the power/impact stroke. Others including U.S. Pat. Nos. 5,984,021, 6,883,618 and 7,267,205 have described methods of controlling the duration of pressurized fluid supply, increasing pressures or using improved materials. Despite these attempts, the proposed solutions have not successfully addressed the problem of inefficiency due to piston deceleration.

OBJECT OF THE INVENTION

It is an object of the present invention to provide an alternate down hole hammer drill and overcome at least in part one or more of the above mentioned problems.

SUMMARY OF THE INVENTION

The present invention was developed as a result of viewing the problem differently and taking an alternate approach. The approach taken was to control the timing of the flow of fluid from the lower chamber thereby reducing the deceleration of the piston. The inventor has developed a dynamic seal tube that moves and seals in coordination with the moving piston. The dynamic seal tube is a tube that slides within the bore of the piston and the anvil portion of the drill bit and co-operatively acts to release different volumes of pressurized fluid from the lower chamber when the piston is in different predetermined positions.

In one aspect the invention broadly resides in a dynamic seal tube being a substantially cylindrical tube with at least one dynamic port partway along the substantially cylindrical tube; wherein in use the dynamic seal tube moves within a piston and a drill bit and co-operatively with the movement of the piston.

Preferably the dynamic seal tube co-operates with the movement of the piston to timely release pressurized fluid from the space between the drill bit and the piston.

Preferably the dynamic seal tube is retained within both the piston and the drill bit.

In one embodiment the dynamic seal tube moves between a seat in the piston and a seat in the drill bit while at the same time co-operating with the movement of the piston to allow air to exhaust through the dynamic port when the piston is in a predetermined position.

In another embodiment the dynamic seal tube has a peripheral lip substantially at each end and in use the dynamic seal tube is retained within the piston and the drill bit by at least one seat in each of the piston and the drill bit.

In another aspect the invention broadly resides in a dynamic seal tube being a substantially cylindrical tube with a peripheral lip substantially at each end and at least one dynamic port partway along the substantially cylindrical tube; wherein in use the dynamic seal tube moves within a piston and a drill bit and co-operatively with the movement of the piston.

In a further aspect the invention broadly resides in a dynamic seal tube being a substantially cylindrical tube with a peripheral lip substantially at each end and at least one dynamic port partway along the substantially cylindrical tube; wherein in use the dynamic seal tube moves within a piston and a drill bit and co-operatively with the movement of the piston, said peripheral lips abut respective seats in the piston and the drill bit while at the same time co-operating with the movement of the piston.

Preferably the dynamic seal tube with the peripheral lip substantially at each end co-operates with the movement of the piston to timely release fluid from the space between the drill bit and the piston.

The dynamic seal tube is preferably retained by at least one seat/detent or protrusion in a lower portion of the piston bore and anvil portion of the drill bit bore.

Preferably the peripheral lip retained within the piston moves between two seats/detents within the internal bore of the piston whereas the peripheral lip retained within the drill bit moves between two seats/detents within the internal bore of the drill bit.

The position of the at least one dynamic port along the cylindrical tube is preferably within a range determined by the functional co-operation of the dynamic seal tube with the piston.

Said at least one dynamic port preferably enables venting of the space between the drill bit and the piston for a selected part of the downward stroke of the piston. Preferably the selected part is that part of the downward stroke of the piston when the dynamic port is not sealed by the drill bit.

Venting from the dynamic port is preferably prevented when the dynamic seal tube slides within the drill bit and the dynamic port is covered during part of the upward stroke of the piston. Venting is preferably prevented during an early stage of the upward stroke of the piston.

Venting from the dynamic port is preferably delayed when the dynamic seal tube slides within the drill bit, and the dynamic port is covered during the upward stroke of the piston and then enabled when the dynamic port becomes uncovered. In one of the preferred embodiments the dynamic port is uncovered when the peripheral lip abuts the seat in the drill bit bore and is retained within the drill bit.

With each of the abovementioned aspects there can be one or more dynamic ports. In an embodiment where there is two or more dynamic ports, they can be spaced apart and or be of different diameters.

In another aspect the invention broadly resides in a dynamic seal tube being a substantially cylindrical tube wherein in use the dynamic seal tube moves within a piston and a drill bit so that when the piston moves upward the end of the cylindrical tube is free of the drill bit thereby allowing exhaust flow through the drill bit bore.

In a further aspect the invention broadly resides in a dynamic seal tube being a substantially cylindrical tube wherein in use the dynamic seal tube moves within an impact end of the piston and a anvil end of the drill bit so that when the piston moves upward the end of the cylindrical tube is free of the drill bit thereby allowing air to flow through the drill bit bore.

Preferably this embodiment of the invention is used in association with a port tube that extends through the piston bore and positions within the drill bit bore. The dynamic seal tube is preferably positioned between the port tube and the internal bore surfaces of the piston and the drill bit. In this preferred embodiment when the dynamic seal tube is raised, it co-operates with the port tube to provide access to an exhaust port when the piston is in a predetermined position.

During development and in particular experimentation to increase the check valve passage clearance to alleviate small debris jamming the check valve revealed that clearance and shape of the check valve was important to performance. Furthermore spring strength and tension were experimented with to achieve better performance. Through continual trial and experimentation an improved check valve was developed that allowed timely passage of pressurized fluid to and from the lower chamber formed between the piston and the drill bit.

It was further found that the improved spring biased check valve could be used with the dynamic seal tube to further increase the performance of the down hole hammer drill.

In another aspect the invention broadly resides in a spring-biased check valve located within a port tube and having a check valve body that is biased to an upper closed position and adapted to close against a lower port tube seat so that when the check valve body is in the upper closed position it is not closed against the lower port tube seat allowing pressurized fluid to divert to a lower section of the port tube and when the check valve body is not in the upper closed position the check valve body is closed against the lower port tube seat thereby preventing diversion of pressurized fluid to the lower section of the port tube. The movement of the check valve body on and off the lower port tube seat forms a diverting check valve.

When the pressure in a lower chamber formed between the piston and the drill bit exceeds and stalls the incoming pressurized fluid supply, the check valve body preferably moves towards its upper closed position and lifts off the lower port tube seat to allow pressurized fluid to enter the lower section of the port tube and exhaust bore of the port tube.

Preferably the position of the close proximity of the lower port tube seat to the pressurized lower chamber, the design and location of the check valve within the check valve/port tube assembly provides a timely flow of pressurized fluid through the exhaust bore to reduce the abrupt deceleration of the piston.

The spring-biased check valve can be used in conjunction and cooperatively with the dynamic seal tube as previously described in its various forms and aspects.

The spring-biased check valve can be used without the dynamic seal tube as previously described.

In another aspect the invention broadly resides in a pressurized fluid down hole hammer drill with a dynamic seal tube as described above in different aspects and forms.

In another aspect the invention broadly resides in a pressurized fluid down hole hammer drill with a dynamic seal tube as described above in different aspects and forms and a spring-biased check valve as described above in different aspects and forms.

In a further aspect the invention broadly resides in a pressurized fluid down hole hammer drill including a drill housing;

a piston with a spring-biased check valve moveable within an internal bore of a port tube;

a drill bit; and a dynamic seal tube as described in one of the abovementioned aspects; wherein in use the dynamic seal tube moves within the piston and the drill bit and co-operates with the movement of the piston to timely release pressurized fluid from the space between the drill bit and the piston.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENTS

Figure 1:
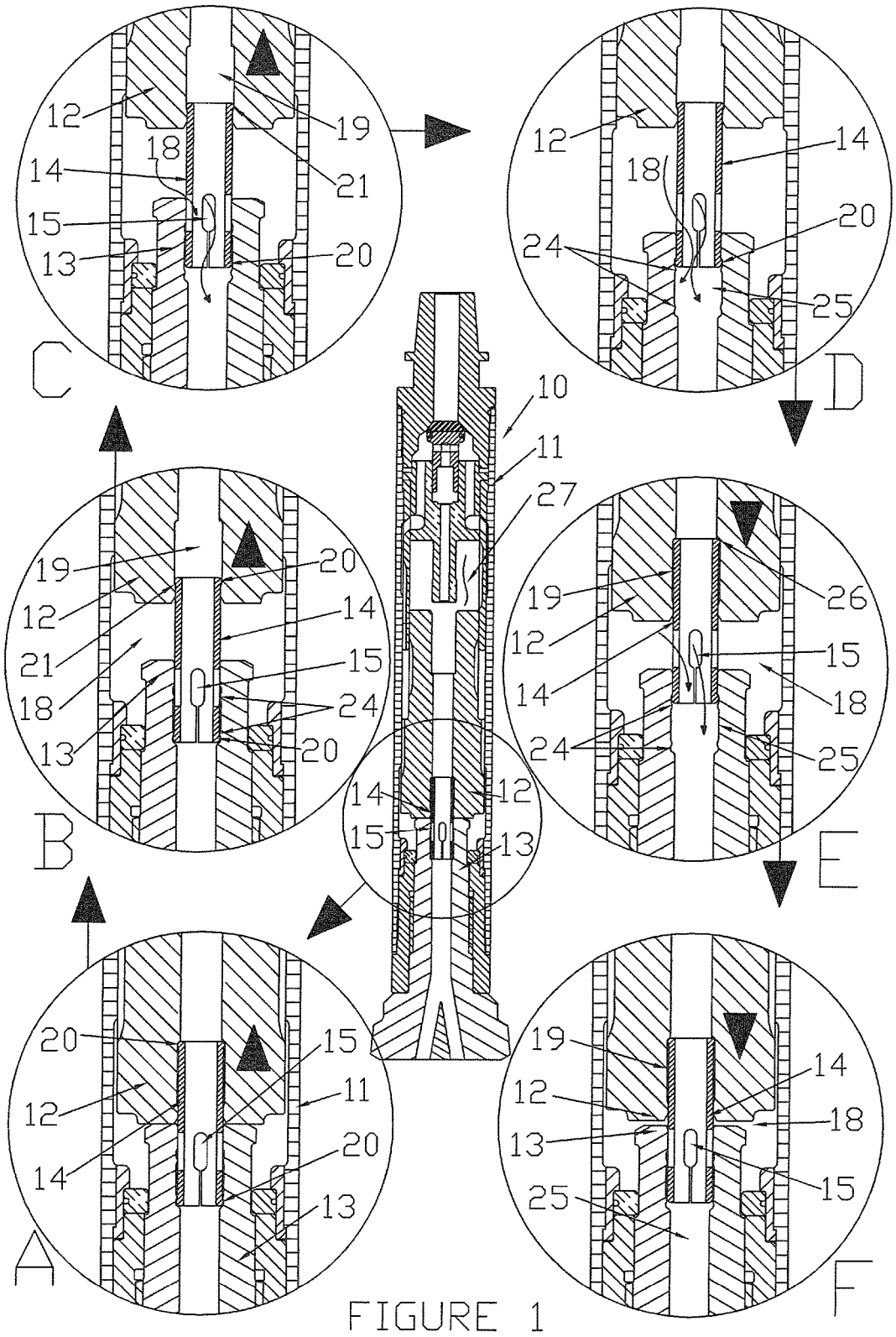
FIG. 1 shows a series of diagrammatic views of the movement of a first preferred embodiment of the dynamic seal tube during different phases of the piston cycle.

With reference to FIG. 1, there is shown a first preferred embodiment of the down hole hammer drill 10 having a drill housing 11, piston 12, drill bit 13 and dynamic seal tube 14. The dynamic seal tube 14 has dynamic port 15. A series of diagrammatic views (A to F) of the movement of the dynamic seal tube 14 during different phases of the cycle of the piston 12 is shown.

In FIG. 1A there is shown a view of the piston 12 at rest atop the drill bit 13 with the dynamic seal tube 14 captive in the bores of both piston and drill bit anvil.

In FIG. 1B pressurized fluid introduced via the porting system forces the piston 12 upward and when the limit of the captive stroke of the dynamic seal tube 14 within the piston bore 19 is reached by the upper peripheral tube lip 20 abutting the piston detent 21, the space 18 between the piston 12 and drill bit 13 is still pressurized and the piston 12 continues to rise, pulling the lower peripheral lip 20 past the lower one of detents 24.

In FIG. 1C the piston 12 continues to lift the dynamic seal tube 14 which is now being extended upwardly from within the captive bore of the drill bit 13. The exhaust port 15 of the dynamic seal tube 14 is open to the pressurized space 18 and the fluid can now pass through to the cutting face of the drill bit 13 for flushing of rock fragment cuttings. As the space 18 is venting, the porting system is charging the upper chamber in preparation for the downward stroke.

In FIG. 1D the piston 12 has now reached the top of its upward movement and the fluid in space 18 is fully discharged via the fully open exhaust port 15. The lower peripheral lip 20 of the dynamic seal tube 14 has now abutted the drill bit upper one of detents 24 to remain retained within the drill bit bore 25.

In FIG. 1E the piston 12 is now forced downwardly due to the increase in pressure in the upper chamber 27 of FIG. 1. The dynamic seal tube 14 within the piston bore 19 remains stationery due to the detent engagement within the drill bit as the piston 12 moves downward. At the same time, fluid continues to be vented from the space 18 as exhaust port 15 remains open. There is no pressurized resistance to the downward movement of the piston 12. The upper piston detent 26 abuts the dynamic seal tube 14 and moves it downward into the drill bit bore 25.

In FIG. 1F the piston 12 impact with the drill bit 13 is imminent. The piston 12 has pushed the dynamic seal tube 14 downward so that the exhaust port 15 is covered and is no longer open to vent from the space 18. Up to this point the downwardly moving piston 12 has not been impeded/decelerated by pressurized fluid in the space 18. As illustrated, a small fraction of the piston stroke remains as a sealed space 18 in which some pressurization may build. At the same time, the porting system has vented the upper chamber and is now pressurizing the space 18 in order to effect the upward stroke. The dynamic seal tube 14 can be designed so that the exhaust port 15 can be positioned higher or lower so as to alter the duration of resistance to the downward movement of the piston 12. The higher the position of the exhaust port 15, the less resistance to the downward movement of the piston 12. The less resistance to the downward movement of the piston 12, greater is the amount of impact energy transferred.

Figure 2:
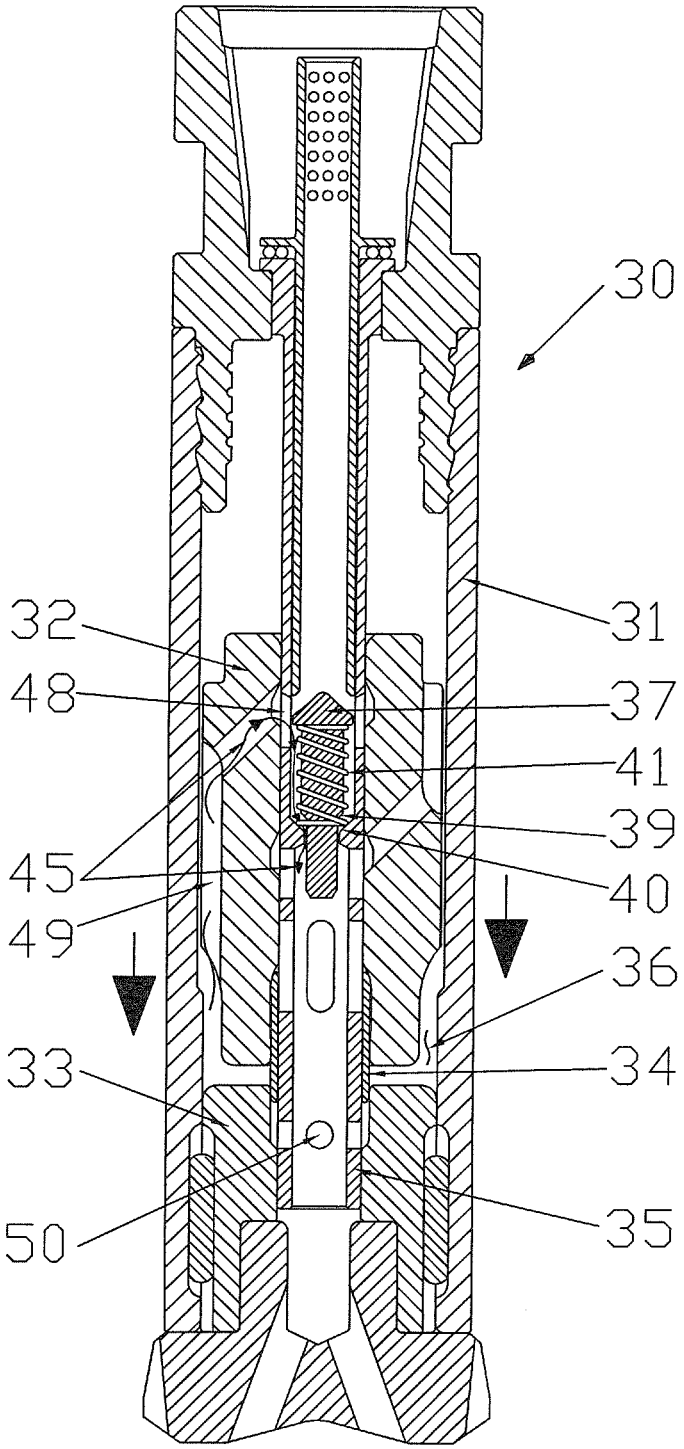
FIGS. 2 to 4 show diagrammatic views of the movement of a second preferred embodiment of the dynamic seal tube during different phases of the piston cycle.
Figure 3:
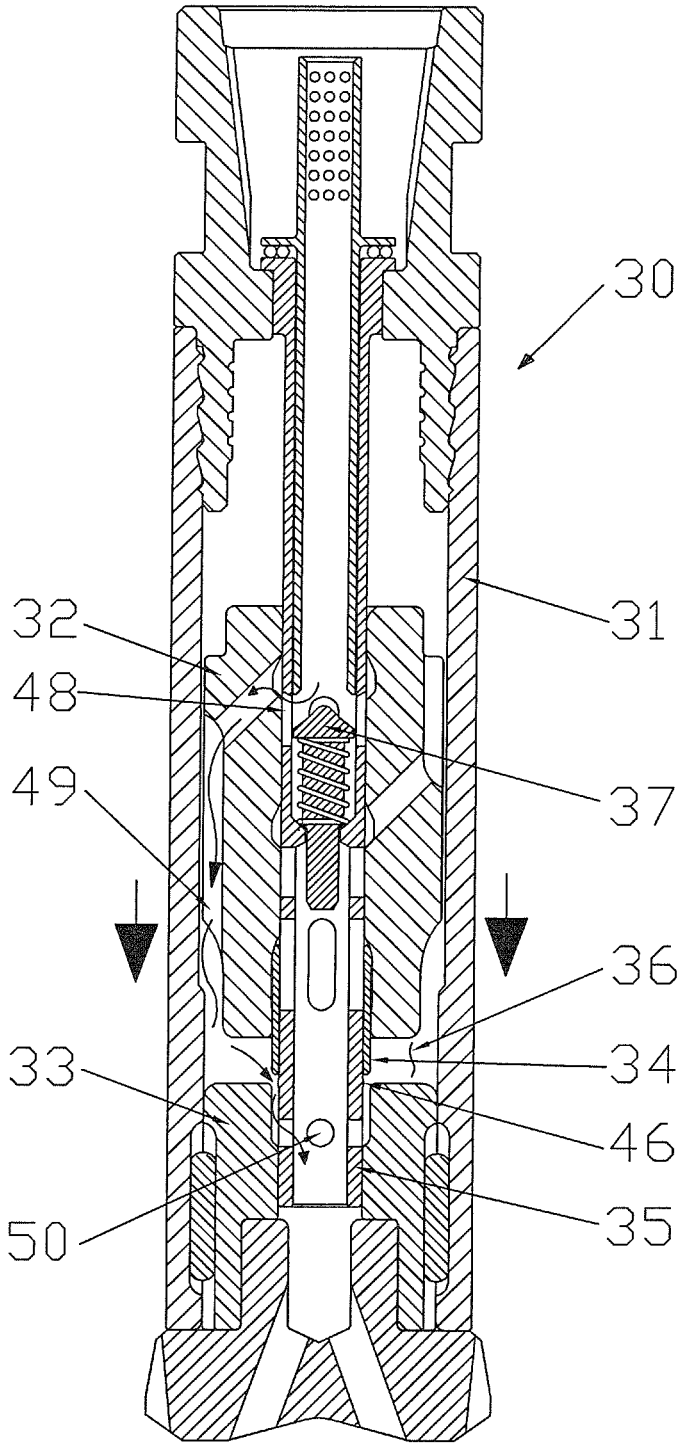
Figure 4:
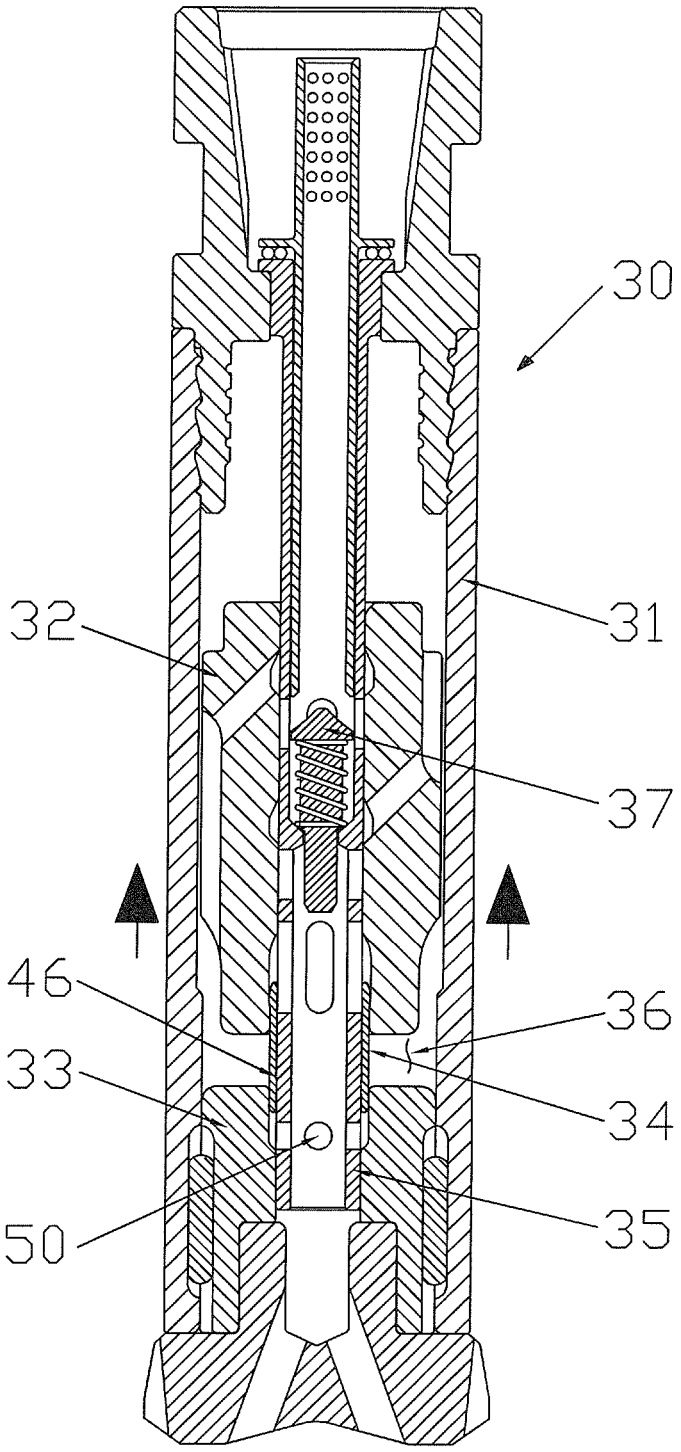

A second embodiment is shown in FIGS. 2 to 4. In this embodiment there is shown a down hole hammer drill 30 having a drill housing 31, piston 32, drill bit 33, port tube 35 and dynamic seal tube 34.

With reference to FIG. 2, the piston 32 is moving downward towards the drill bit 33. The dynamic seal tube 34 has closed the path of exhaust air to the lower chamber exhaust port 50 and the piston 32 is pressurizing fluid in the lower chamber 36. A pressure spike is formed as the pressure in lower chamber 36 exceeds and stalls the incoming pressurized supply. Instantly the spring 41 biases the check valve 37 toward its upper closed position.

This momentary lift of the body of the check valve 37 toward the upward closed position allows a secondary, diverting check 39 which seats against seat 40 and which limits the downward stroke of the check valve 37 against the spring 41, to simultaneously rise and divert the pressure spike via piston conduit 49 and port tube supply port 48 to the exhaust bore of the port tube via an exhaust path (shown by arrows 45) exposed by the lifting of the seat of the secondary check 39 from contact with the seat 40. This relieves and diverts the pressure spike and reduces the abrupt deceleration of the piston 32.

This process occurs in milliseconds and is effective due to the close proximity of the diverting check valve to the pressurized lower chamber, and due to the design and location of the check valve within the check valve/port tube assembly. The check valve serves to eliminate the air distributor component of a traditional hammer drill and shortens the overall assembly. The position of the check valve within the hammer drill assembly and the design of the check valve provides an advantage that enables the hammer drill to be considerably shorter and weigh less than traditional hammer drills. This advantage translates to a less expensive hammer drill and a hammer drill that can be easy to work with and handled.

With reference to FIG. 3, the hammer drill is shown prior to impact. The piston 32 descends during the power stroke with the dynamic seal tube 34 fully retracted due to frictional interaction with the port tube and/or due to contact with a linear detent 46 on the port tube, where at a fixed point the pressurized supply of the lower chamber 36 begins via the alignment of supply port 48 and conduit 49.

Note that a detent/positioning mechanism within any embodiment may take more than one form in order to effect the desired positioning of the dynamic seal tube during the operational cycle.

In this situation the lower chamber 36 remains exposed to exhaust via lower chamber exhaust port 50 until the exhaust is shut off by the descending piston 32 forcing the dynamic seal tube 34 past the detent 46 to a point prior to impact that is determined by the position of the fixed ports of the port tube 35 and the dimensional relationship of the dynamic seal tube 34. The dimensional variations of the dynamic seal tube will cause a variation of how long the exhaust remains open in relation to the moment of impact between piston 32 and drill bit 33. With this, deceleration of the piston 32 can be avoided and thereby providing substantially maximum impact force to the drill bit 33.

With reference to FIG. 4, hammer drill 30 is shown after impact. The lower chamber 36 continues to be charged with pressurized fluid, the piston 33 rises and the dynamic seal tube 34 remains held by linear detent 46 to ensure the dynamic seal tube is at its maximum extent within the piston so that a sufficient duration of pressurization lifts the piston 33 and the dynamic seal tube moves upward until the lower chamber exhaust port 50 is again exposed to enable discharge from the lower chamber 36. The piston 33, together with the dynamic seal tube 34, continues to rise under the momentum until pressurization of the upper chamber halts and reverses the piston and the cycle repeats.

The pressurization cycles are fixed and only the exhaust function of the lower chamber during the impact/power stroke is variable via the dimensional determination (selected linear engagement and length) of the Dynamic Seal Tube.

In another preferred embodiment, the dynamic seal tube shown in FIG. 1 may be configured to have a greater retaining capacity in one of the piston or drill bit. In one form, the dynamic seal tube is preferably configured or shaped to allow relatively easy separation from the drill bit so that the drill bit can be replaced while retaining the functionality of the dynamic seal tube. In another form, the dynamic seal tube arrangement is configured or shaped to function upside down, where the dominant captive retention is configured in the drill bit and the more easily removed portion in the piston.

Figure 5:
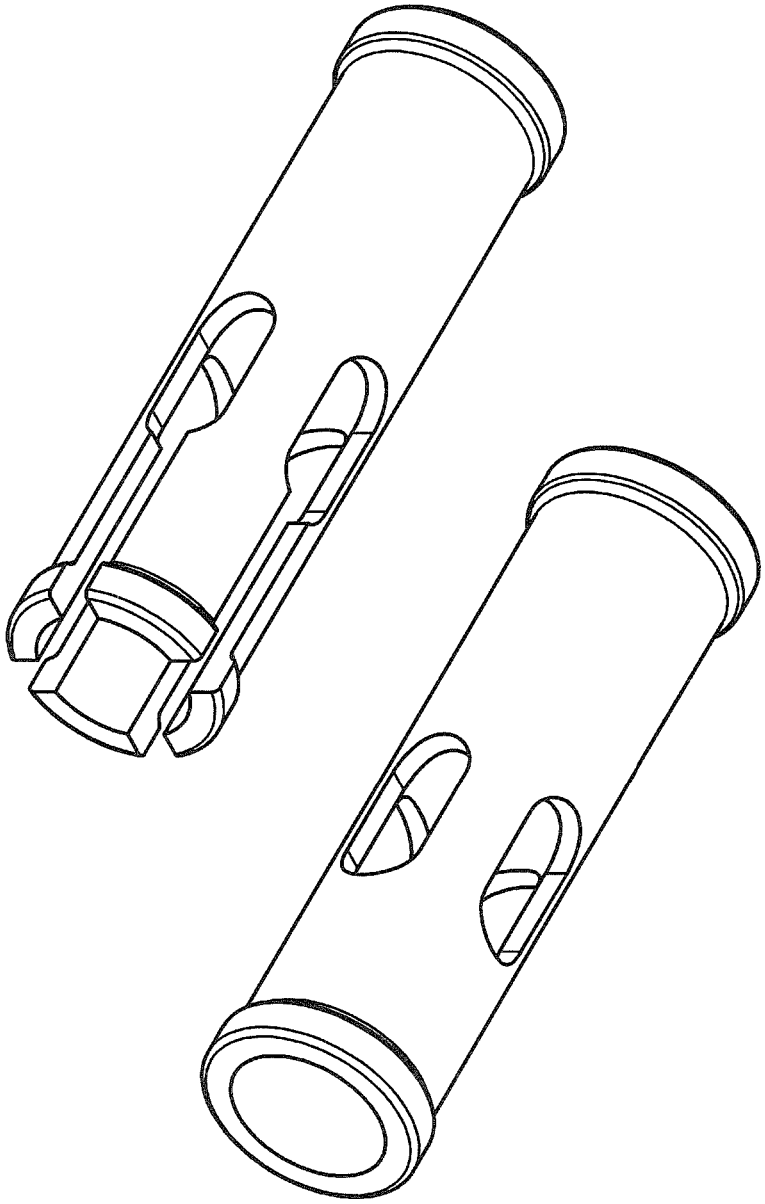
FIG. 5 shows alternate embodiments of the dynamic seal tube.

With reference to FIG. 5, alternate embodiments of the dynamic seal tube are shown where one end has at least one slot to provide a degree of flexibility and have a different retention capacity compared with the other end. The number of slots and the length of the slots can vary depending on the amount of desired retention, and/or desired fluid bypass.

Furthermore the material from which the dynamic seal tube is made can affect the retention capacity. The preferred material of the dynamic seal tube is a plastic polymer selected to withstand the operational environment. However, a metallic dynamic seal tube is also a practical alternative.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. A pressurized fluid down hole hammer drill comprising a drill housing;

a piston with a spring-biased check valve moveable within an internal bore of a port tube; wherein the spring-biased check valve is located within the port tube and having a check valve body that is biased to an upper closed position and adapted to close against a lower port tube seat so that when the check valve body is in the upper closed position it is not closed against the lower port tube seat allowing pressurized fluid to divert to a lower section of the port tube and when the check valve body is not in the upper closed position the check valve body is closed against the lower port tube seat thereby preventing diversion of pressurized fluid to the lower section of the port tube;

a drill bit; and a dynamic seal tube being a substantially cylindrical tube with at least one dynamic port partway along the substantially cylindrical tube; wherein in use the dynamic seal tube moves within the piston and the drill bit and co-operates with the movement of the piston to timely release pressurized fluid from the space between the drill bit and the piston.

2. A pressurized fluid down hole hammer drill comprising a drill housing;

a piston with a spring-biased check valve moveable within an internal bore of a port tube;

a drill bit; and a dynamic seal tube being a substantially cylindrical tube with at least one dynamic port partway along the substantially cylindrical tube; wherein in use the dynamic seal tube moves within the piston and the drill bit and co-operates with the movement of the piston to timely release pressurized fluid from the space between the drill bit and the piston, wherein the spring-biased check valve is located within the port tube and having a check valve body that is biased to an upper closed position and adapted to close against a lower port tube seat so that when the check valve body is in the upper closed position it is not closed against the lower port tube seat allowing pressurized fluid to divert to a lower section of the port tube and when the check valve body is not in the upper closed position the check valve body is closed against the lower port tube seat thereby preventing diversion of pressurized fluid to the lower section of the port tube; wherein when the pressure in a lower chamber formed between the piston and the drill bit exceeds and stalls the incoming pressurized fluid supply, the check valve body moves towards its upper closed position and lifts off the lower port tube seat to allow pressurized fluid to enter the lower section of the port tube and exhaust bore of the port tube.

3. The pressurized fluid down hole hammer drill of claim 2, wherein the position of the at least one dynamic port along the cylindrical tube is within a range determined by the functional co-operation of the dynamic seal tube with the piston.

4. The pressurized fluid down hole hammer drill of claim 2, wherein there is one or more dynamic ports.

5. The pressurized fluid down hole hammer drill of claim 2, wherein there is a plurality of dynamic ports and each of the dynamic ports can be separated apart from each other by a different spacing and or be of different diameters.

6. The pressurized fluid down hole hammer drill of claim 2, wherein the dynamic seal tube is retained within both the piston and the drill bit.

7. A pressurized fluid down hole hammer drill comprising a drill housing;

a piston with a spring-biased check valve moveable within an internal bore of a port tube;

a drill bit; and a dynamic seal tube being a substantially cylindrical tube with at least one dynamic port partway along the substantially cylindrical tube; wherein in use the dynamic seal tube moves within the piston and the drill bit and co-operates with the movement of the piston to timely release pressurized fluid from the space between the drill bit and the piston, wherein the spring-biased check valve is located within the port tube and having a check valve body that is biased to an upper closed position and adapted to close against a lower port tube seat so that when the check valve body is in the upper closed position it is not closed against the lower port tube seat allowing pressurized fluid to divert to a lower section of the port tube and when the check valve body is not in the upper closed position the check valve body is closed against the lower port tube seat thereby preventing diversion of pressurized fluid to the lower section of the port tube; wherein the close proximity of the lower port tube seat to the pressurized lower chamber, the design and location of the check valve within the check valve and port tube arrangement provides a timely flow of pressurized fluid through an exhaust bore of the port tube to reduce the abrupt deceleration of the piston.

8. A pressurized fluid down hole hammer drill comprising a drill housing;

a piston with a spring-biased check valve moveable within an internal bore of a port tube;

a drill bit; and a dynamic seal tube being a substantially cylindrical tube with at least one dynamic port partway along the substantially cylindrical tube; wherein in use the dynamic seal tube moves within the piston and the drill bit and co-operates with the movement of the piston to timely release pressurized fluid from the space between the drill bit and the piston, wherein the at least one dynamic port enables venting of the space between the drill bit and the piston for a selected part of the downward stroke of the piston, wherein the selected part is that part of the downward stroke of the piston when the dynamic port is not sealed by the drill bit.

9. A pressurized fluid down hole hammer drill comprising a drill housing;

a piston with a spring-biased check valve moveable within an internal bore of a port tube;

a drill bit; and a dynamic seal tube being a substantially cylindrical tube with at least one dynamic port partway along the substantially cylindrical tube; wherein in use the dynamic seal tube moves within the piston and the drill bit and co-operates with the movement of the piston to timely release pressurized fluid from the space between the drill bit and the piston, wherein venting from the dynamic port is prevented when the dynamic seal tube slides within the drill bit and the dynamic port is covered during part of the upward stroke of the piston, wherein venting is prevented during an early stage of the upward stroke of the piston.

10. A pressurized fluid down hole hammer drill comprising a drill housing;

a piston with a spring-biased check valve moveable within an internal bore of a port tube;

a drill bit; and a dynamic seal tube being a substantially cylindrical tube with at least one dynamic port partway along the substantially cylindrical tube; wherein in use the dynamic seal tube moves within the piston and the drill bit and co-operates with the movement of the piston to timely release pressurized fluid from the space between the drill bit and the piston, wherein venting from the dynamic port is delayed when the dynamic seal tube slides within the drill bit, and the dynamic port is covered during the upward stroke of the piston and then enabled when the dynamic port becomes uncovered.

11. A pressurized fluid down hole hammer drill comprising a drill housing;

a piston with a spring-biased check valve moveable within an internal bore of a port tube;

a drill bit; and a dynamic seal tube being a substantially cylindrical tube with at least one dynamic port partway along the substantially cylindrical tube; wherein in use the dynamic seal tube moves within the piston and the drill bit and co-operates with the movement of the piston to timely release pressurized fluid from the space between the drill bit and the piston, wherein in use the dynamic seal tube moves within the piston and the drill bit so that when the piston moves upward the end of the cylindrical tube is free of the drill bit thereby allowing exhaust flow through a drill bit bore.

12. A pressurized fluid down hole hammer drill comprising a drill housing;

a piston with a spring-biased check valve moveable within an internal bore of a port tube;

a drill bit; and a dynamic seal tube being a substantially cylindrical tube with at least one dynamic port partway along the substantially cylindrical tube; wherein in use the dynamic seal tube moves within the piston and the drill bit and co-operates with the movement of the piston to timely release pressurized fluid from the space between the drill bit and the piston, wherein in use the dynamic seal tube moves within an impact end of the piston and an anvil end of the drill bit so that when the piston moves upward the end of the cylindrical tube is free of the drill bit thereby allowing air to flow through a drill bit bore.

* * * * *